US005850877A

United States Patent [19]

Albright et al.

[11] Patent Number: 5,850,877

[45] Date of Patent: Dec. 22, 1998

[54] JOINT COMPENSATOR

[75] Inventors: Stephen L. Albright, Houston, Tex.; Jean Donald Bearb, Church Point, La.

[73] Assignee: Weatherford/Lamb, Inc., Houston, Tex.

[21] Appl. No.: 706,983

[22] Filed: Aug. 23, 1996

[51] Int. Cl.[6] ..... E21B 15/00

[52] U.S. Cl. ..... 166/77.51; 175/85; 414/22.51

[58] Field of Search ..... 414/22.51; 166/77.51, 166/77.52; 175/85, 171

[56] References Cited

U.S. PATENT DOCUMENTS

| | | | |
|---|---|---|---|
| 1,454,194 | 5/1923 | Thomas . | |
| 1,842,638 | 1/1932 | Wigle . | |
| 1,891,832 | 12/1932 | Parks | 166/77.52 |
| 2,622,916 | 12/1952 | Libin et al. . | |
| 2,661,979 | 12/1953 | Stone . | |
| 3,037,803 | 6/1962 | Phillips . | |
| 3,193,116 | 7/1965 | Kenneday et al. . | |
| 3,351,372 | 11/1967 | Marks et al. | 294/81 |
| 4,652,195 | 3/1987 | McArthur | 414/22 |
| 4,681,158 | 7/1987 | Pennison | 166/77.5 |
| 4,921,386 | 5/1990 | McArthur | 414/22.51 |
| 5,049,020 | 9/1991 | McArthur | 414/22.51 |
| 5,062,756 | 11/1991 | McArthur et al. | 414/22.51 |
| 5,390,568 | 2/1995 | Pietras | 81/57.16 |

FOREIGN PATENT DOCUMENTS

| | | |
|---|---|---|
| 1239634 | 4/1985 | Canada . |
| 0171144A | 2/1986 | European Pat. Off. . |
| 1497666A | 10/1967 | France . |
| PCT/GB80/ 00196 | 11/1980 | United Kingdom . |

OTHER PUBLICATIONS

"Joy Web Wilson Hydra Hooks," Joy Petroleum Equip., 1982.

"Web Wilson Return–A–Matic Hooks," Joy Petroleum Equip., 1975.

"Model 14.5–50 Hydraulic Power Tong," Weatherford, 1993, pp. § 1, 1, 6; ≥ 2, 4, 5, 6; § 3, 4; § 8, 29.

Int'l Search Report for application PCT/GB97/02274, filed 26 Aug. 1997, counterpart of this case Ser. No. U.S. 08/706,983.

*Primary Examiner*—William Neuder

*Attorney, Agent, or Firm*—Guy McClung

[57] ABSTRACT

New joint compensator and systems and methods of their use have been invented which, in one aspect are useful for compensating for the weight of a first joint and at least one subsequent joint, the first joint to be supported above the at least one subsequent joint, the joint compensator in one aspect having a body interconnectible between the first joint and moving apparatus, the body including supporting apparatus for supporting the first joint above the at least one subsequent joints and for providing support of the first joint as it moves with respect to the at least one subsequent joint, the supporting apparatus compensating for weight of the first joint as it moves, the support apparatus for alternately supporting the first joint and then the at least one subsequent joint, the support apparatus initially adjustable to compensate for the weight of the first joint so that the support apparatus is also thereby adjusted to compensate for weight of the at least one subsequent joint.

15 Claims, 11 Drawing Sheets

FIG. 4

| A | B | C | D | E |
|---|---|---|---|---|
| Lbs/ft | Weight | Neutral | PSI Make | PSI Break |
| 17 | 680 | 9 | 5 | 10 |
| 20 | 800 | 11 | 6 | 12 |
| 23 | 920 | 12 | 7 | 13 |
| 24 | 960 | 13 | 8 | 14 |
| 26 | 1040 | 14 | 8 | 15 |
| 26.4 | 1056 | 14 | 8 | 15 |
| 28 | 1120 | 15 | 9 | 16 |
| 32 | 1280 | 17 | 10 | 18 |
| 32.3 | 1292 | 17 | 10 | 19 |
| 32.75 | 1310 | 17 | 10 | 19 |
| 36 | 1440 | 19 | 11 | 21 |
| 40 | 1600 | 21 | 13 | 23 |
| 40.5 | 1620 | 21 | 13 | 23 |
| 42 | 1680 | 22 | 13 | 24 |
| 45.5 | 1820 | 24 | 14 | 26 |
| 47 | 1880 | 25 | 15 | 27 |
| 48 | 1920 | 25 | 15 | 28 |
| 51 | 2040 | 27 | 16 | 29 |
| 54 | 2180 | 28 | 17 | 31 |
| 54.5 | 2180 | 29 | 17 | 31 |
| 55.5 | 2220 | 29 | 17 | 32 |
| 60 | 2400 | 32 | 19 | 35 |
| 61 | 2440 | 32 | 19 | 35 |
| 65 | 2600 | 34 | 20 | 38 |
| 68 | 2720 | 35 | 21 | 39 |
| 72 | 2880 | 38 | 23 | 42 |
| 75 | 3000 | 39 | 24 | 43 |
| 84 | 3360 | 44 | 26 | 49 |
| 87.5 | 3500 | 46 | 28 | 51 |
| 94 | 3760 | 49 | 30 | 54 |
| 106.5 | 4280 | 56 | 34 | 62 |
| 133 | 5320 | 70 | 42 | 77 |
| 150 | 6000 | 79 | 47 | 87 |

| A | B | C | D | E |
|---|---|---|---|---|
| Lbs/ft | Weight | Neutral | PSI Make | PSI Break |
| 2.6 | 78 | 12 | 7 | 14 |
| 4 | 120 | 19 | 11 | 21 |
| 4.6 | 138 | 22 | 13 | 24 |
| 4.7 | 141 | 22 | 13 | 25 |
| 5.8 | 174 | 28 | 17 | 30 |
| 5.95 | 179 | 28 | 17 | 31 |
| 6.4 | 192 | 31 | 18 | 34 |
| 6.5 | 195 | 31 | 19 | 34 |
| 7.7 | 231 | 37 | 22 | 40 |
| 7.8 | 234 | 37 | 22 | 41 |
| 7.9 | 237 | 38 | 23 | 42 |
| 8.6 | 258 | 41 | 25 | 45 |
| 8.7 | 261 | 42 | 25 | 46 |
| 9.2 | 276 | 44 | 26 | 48 |
| 9.3 | 279 | 44 | 27 | 49 |
| 9.5 | 285 | 45 | 27 | 50 |
| 10.2 | 306 | 49 | 29 | 54 |
| 11 | 330 | 53 | 32 | 58 |
| 12.7 | 381 | 61 | 36 | 67 |
| 12.75 | 383 | 61 | 37 | 67 |
| 12.95 | 389 | 62 | 37 | 68 |
| 15.5 | 465 | 74 | 44 | 81 |

FIG. 5

JOINT COMPENSATOR

FIELD OF THE INVENTION

This invention is directed to methods and apparatuses for connecting tubular members, for example tubing or casing members; and, in one aspect, to a joint compensator useful in such methods.

DESCRIPTION OF THE RELATED ART

In many drilling applications, and especially in deep high pressure wells, one or more casing strings are set to protect the well bore and/or the formation. Whether the crew members are running surface, intermediate, or production casing, the handling of these heavy individual casing members presents special problems.

In particular, considerable skill is needed to lower the new casing into position on the assembled casing string and to make the necessary threaded connection between the pin on the new casing and the box on the top of the assembled casing string. Thus, if the new casing is positioned too high above the box on the assembled string, the threads do not engage. On the other hand, if the pin is lowered too far, the full weight of the new casing may rest on the first thread of the assembled string and damage may occur. This may require removal of the damaged casing(s) and costly delays. Even if no thread damage initially occurs as a result of lowering the casing pin too far, if it rests on the assembled string, the worker (the "stabber") may have difficulty in manoeuvring the casing to align it so as to make a proper threaded connection. In the event of such a misalignment, cross threading or other thread damage is likely to occur.

SUMMARY OF THE PRESENT INVENTION

The present invention discloses, in certain embodiments, systems and methods for facilitating the joining of two tubular members. In one aspect such a system has a piston mounted in a cylinder with a pneumatic fluid, e.g. air, above and below the piston. A piston rod extends out from the bottom of the cylinder and is connectible to a free joint that is to be joined ("made up") to a fixed joint, e.g. a joint fixed in slips on a rig floor. The top of the cylinder is interconnected with a typical rig travelling block so that the piston/cylinder device may be raised and lowered within the rig. An elevator may be used between the travelling block and the piston/cylinder device. Top and bottom stops in the cylinder limit piston upward and downward movement respectively.

A mechanical rod extends into the cylinder and projects slightly above the bottom stop. The mechanical rod is movable to operate a valve to permit air to flow from an air source (which provides air into the cylinder) to a pressure indicating gauge so that an operator will know when the piston has reached the downward limit of its stroke.

A series of valves and related circuits, flow lines, and apparatuses controls air flow to the cylinder. For a make-up operation a make-up regulator valve is set so that air at a desired pressure is permitted to flow into the cylinder. A pressure relief valve is set to relieve pressure should it exceed some pre-set relief pressure level. A selector valve permitts air to flow from either the make-up regulator valve or a break-out regulator valve. A vent valve permits venting of air from the cylinder during a break-out operation. Once the desired amount of air pressure has been introduced into the cylinder for a make-up operation for a first free joint, the cylinder is ready for each succeeding joint; i.e., no operator intervention is needed for this setting for making-up a plurality of joints. This automatic feature facilitates the make-up operation. The present invention, in certain aspects, discloses a joint compensator for compensating for the weight of a first joint and at least one subsequent joint, the first joint to be supported above the at least one subsequent joint, the joint compensator having a body interconnectible between the first joint and moving apparatus, the body including supporting apparatus for supporting the first joint above the at least one subsequent joints and for providing support of the first joint as it moves with respect to the at least one subsequent joint, the supporting apparatus compensating for weight of the first joint as it moves, the support apparatus for alternately supporting the first joint and then the at least one subsequent joint, the support apparatus initially adjustable to compensate for the weight of the first joint so that the support apparatus is also thereby adjusted to compensate for weight of the at least one subsequent joint; such a joint compensator wherein the first joint is a free joint and the at least one subsequent joint is a free joint, the first joint moved to contact and engage a fixed joint after which the at least one subsequent joint is moved to contact and engage the first joint; such a joint compensator wherein the first joint is a fixed joint connected to the at least one subsequent joint, the first joint moved to disengage from the at least one subsequent joint after which the at least one subsequent joint is moved to disengage from a third fixed joint to which the at least one subsequent joint is connected; such a joint compensator wherein the joint compensator continuously compensates for weight of a joint connected thereto; such a joint compensator wherein the support apparatus comprises a movable piston movably mounted in a hollow cylinder with an amount of gas above the piston and an amount of gas below the piston, the piston connected to a piston rod part of which projects from the cylinder for interconnection to a joint to be supported by the joint compensator; such a joint compensator wherein the support apparatus comprises a movable piston movably mounted in a hollow cylinder with a first spring cushion for cushioning the piston on a first side of the piston and a second spring cushioning for cushioning the piston on a second side of the piston; such a joint compensator wherein the first spring cushion is at least one constant force spring; such a joint compensator wherein the second spring cushion is at least one constant force spring; such a joint compensator wherein the first spring cushion is an amount of air; such a joint compensator wherein the second spring cushion is an amount of air; such a joint compensator with control apparatus for selectively controlling the first spring cushion and the second spring cushion; such a joint compensator wherein the first spring cushion is an amount of gas, the second spring cushion is an amount of gas, and the control apparatus further comprises a valving system and a fluid flow line system interconnecting the first spring cushion, the second spring cushion and a source of gas under pressure from which flows gas for the first spring cushion and the second spring cushion.

This invention resides not in any particular individual feature, but in the combinations of them herein disclosed and claimed and it is distinguished from the prior art in these combinations with their structures and functions.

There has thus been outlined, rather broadly, features of the invention in order that the detailed descriptions thereof that follow may be better understood, and in order that the present contributions to the arts may be better appreciated. There are, of course, additional features of the invention that will be described hereinafter and which may form the subject matter of the claims appended hereto. Those skilled in the art will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar that do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings from a part of this specification. It is to be noted, however, that the appended drawings illustrate certain preferred embodiments of the invention and are therefore not to be considered limiting of its scope, for the invention may admit to other equally effective or equivalent embodiments.

FIGS. 4 and 5 are charts presenting data regarding joints and valve settings for methods according to the present invention.

DESCRIPTION OF EMBODIMENTS PREFERRED AT THE TIME OF FILING FOR THIS PATENT

It is an object of at least certain preferred embodiments of this invention to provide new, useful, unique, effective and nonobvious systems and methods for supporting and compensating for the weight of a joint to be connected to or disengaged from another joint.

Figure 1:
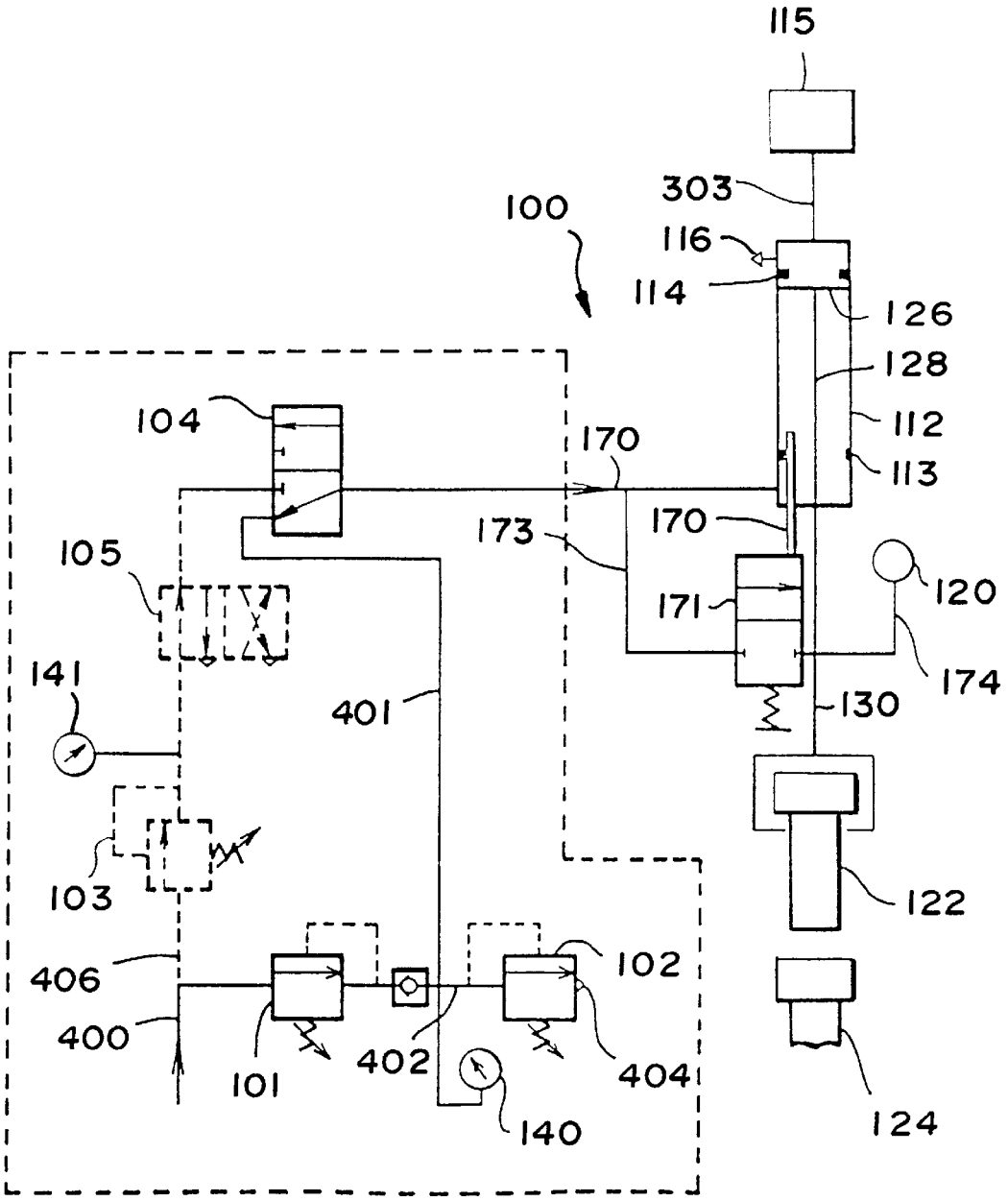
FIG. 1 is a schematic view of a system according to the present invention.

FIG. 1 shows a system 100 according to the present invention for joining (making-up) or disconnecting (breaking-out) two tubulars, e.g. a free casing 122 and a fixed casing 124. In a typical make-up operation, a selector valve 104 is placed in a position as shown so that air from an air source (pressurized air source not shown) can flow in a line 400 to a make-up regulator valve 101, in a line 401, through the selector valve 104, through a line 170, into a hollow cylinder 112 beneath a piston 126 movably mounted in the hollow cylinder 112. A pressure relief valve 102 controls air flow in a line 402 and out through a vent 404. A gauge 405 indicates air pressure level in the line 401.

A break out regulator valve 103 is closed so air does not flow through a line 406. Initially the make-up regulator valve 101 is also closed. The valve 101 is set to a setting (an air pressure level) which corresponds to a force that equals about a portion of the weight of the free joint 122 (an air pressure which is a percentage of that pressure which could support the weight of the free joint 122); e.g. at about 40% of the free joint weight or greater. In one aspect the make-up regulator valve is set at an air pressure that corresponds to about 60% of the weight of the free joint 122. This weight can be determined by using a chart that specifies such weights; a computerized look-up table; or by using the cylinder 112 as follows: air is permitted to flow into the cylinder 112 by opening the make-up regulator valve 101 so the piston 126 goes up in the cylinder 112; using the relief valve 102, air is then permitted to escape from the cylinder 112 until the piston 126 starts to move down, indicated by watching the gauge 140; the pressure reading from the gauge is noted which corresponds to the weight of the free joint. With the make-up regulator valve set, e.g. at about 60% of the free joint weight, the free joint 122 is picked up (e.g. with a line 130 connected to the piston rod 128) and the piston 126 is within the cylinder 112 not at its top nor at its bottom.

The downward limit of travel of piston 126 is indicated when the piston 126 contacts a movable rod 170 which opens a valve 171, permitting air from the line 170 to flow in a line 173 and in a line 174 to a gauge 120 thus providing a visual indication and/or air signal to indicate that the piston 126 has reached the downward limit of its travel. With the piston in mid stroke and relief valve 102 closed, the relief valve 102 is opened gradually by an operator who watches the free joint 122. When the free joint 122 moves down, the relief valve 102 is closed. At this point the free joint 122 is supported by the piston/cylinder device and the piston 126 is not at either limit (up or down) of its movement. The setting of the relief valve 102 is now increased slightly beyond that necessary to arrest downward motion of the piston. The free joint 122 is now "stabbed" manually into the fixed joint 124 by manually pulling down on the free joint 122 or by lowering a rig line 303. As the free joint 122 is pulled down, the piston 126 is lowered, increasing air pressure in the cylinder 112. The increased air pressure exceeds the pressure setting of the relief valve 102 and the excess pressure is thereby vented through the vent 404 as the free joint 122 is moved down.

In the event the free joint is not stabbed correctly into the fixed joint, the piston/cylinder device still supports the weight of the free joint and, if the free joint touches the fixed joint, damage to the fixed joint (and to the free joint) is reduced or eliminated. If the travelling block, etc. continues downward movement after an unsuccessful stabbing attempt and the fixed joint is supporting some portion of the weight of the free joint, the piston 126 goes up in the cylinder 112, the gas in the cylinder expands and the piston/cylinder device accommodates the downward motion of the travelling block, etc. so the fixed joint only supports part of the free joint's weight—in certain embodiments preferably no more than 5%, 10%, 25%, 50%, or 70% of the free joint's weight.

Once the free joint 122 is stabbed correctly into the fixed joint 124, the free joint 122 is rotated (e.g. with any known tong or rotator) to engage the fixed joint (e.g. threadedly) and move down as make-up commences. As the free joint moves down, air pressure in the cylinder 112 increases.

When it exceeds the set relief pressure of the relief valve 102, excess pressure is vented through the vent 404, while a cushion of air continues to support the free joint until make-up is completed.

Then the travelling block is lowered so an elevator attached to the previously free joint can be released. Upon such release, the piston 126 moves to the top stop 114—i.e., the piston 126 automatically moves up to a position suitable for picking up another free joint for making up with the previously-free now-fixed joint 122; etc. until a desired number of joints are made up.

Figure 2:
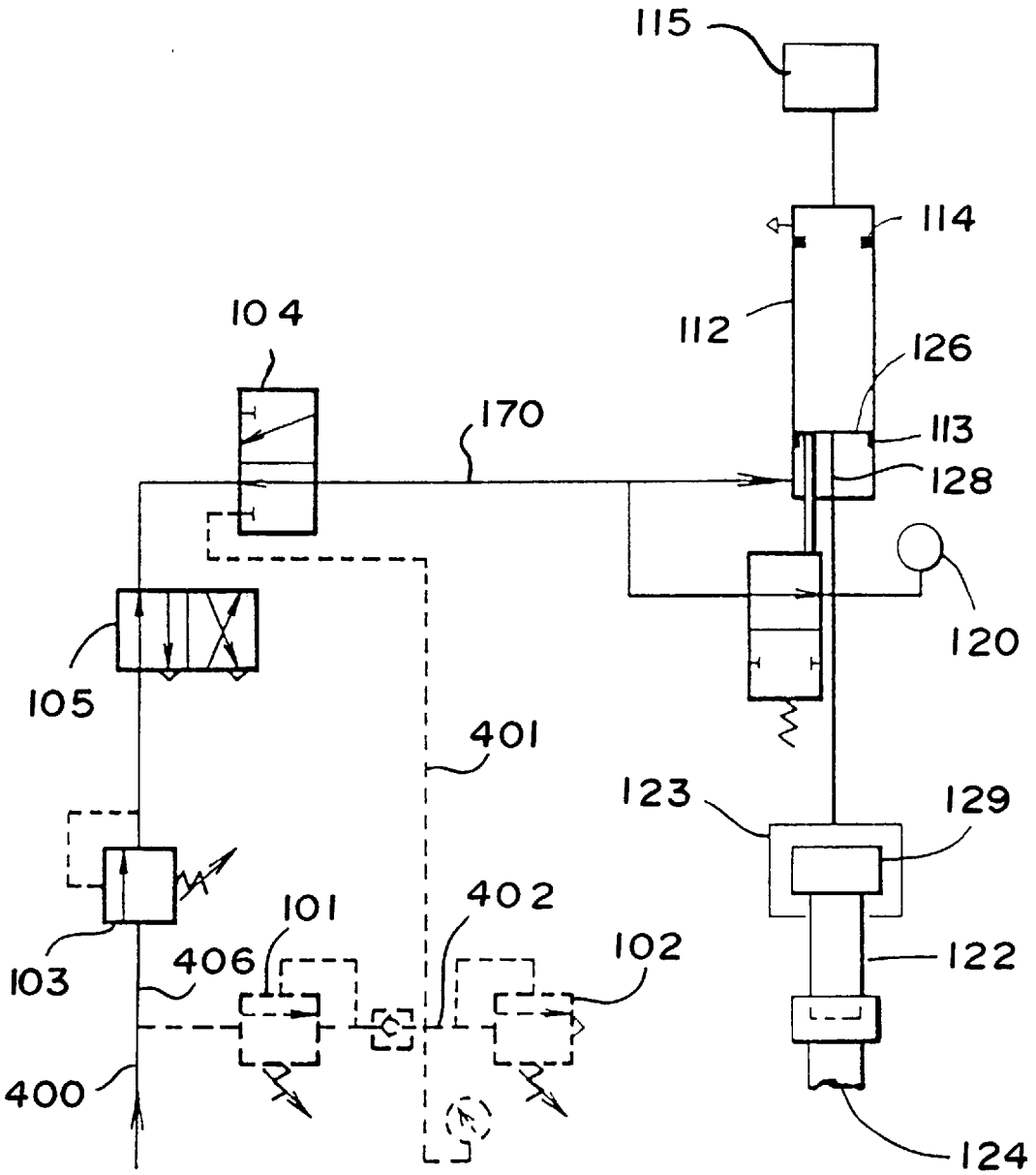
FIG. 2 is another schematic view of the system of FIG. 1.

In a typical breakout operation according to the present invention, the breakout regulator valve 103 is set to a pressure corresponding to an amount greater than the weight of a joint to be disconnected; in certain aspects about 102%, 104%, 105%, 110%, 115%, or 125% of said weight. Selector valve 104 is set to the breakout position. Vent valve 105 is opened to release air from underneath the piston 126 and the piston 126 moves down to contact the stop 113 as indicated by the gauge 120. A clamp (e.g. a single joint elevator) 123 connected to the line 130 (as is used in make-up operations) is clamped below a collar 129 of the joint 122. Vent valve 105 is closed so air is allowed to enter, under pressure, beneath the piston 126 (see FIG. 2), resulting in the lifting of the clamp 123 to contact the collar 129—at which point the pressurized air in the cylinder 112 is sufficient to support the joint 122. The breakout regulator valve 103 could be set at a pressure about equal to the joint weight; but preferably the pressure regulator valve 103 is set at a pressure corresponding to more than the joint weight so that upon turning and freeing of the joint, the joint is raised and does not contact or bounce on the joint from which it has been disconnected thereby reducing injury to both members. As the joint 122 is unscrewed it is constantly supported.

The freed joint is then disconnected from the elevator 123 at which point the piston 126 raises to contact the top stop 114. The vent valve 105 is then operated to vent air so the piston 126 moves down to contact the stop 113. At this point the breakout of another joint may be commenced.

Figure 3:
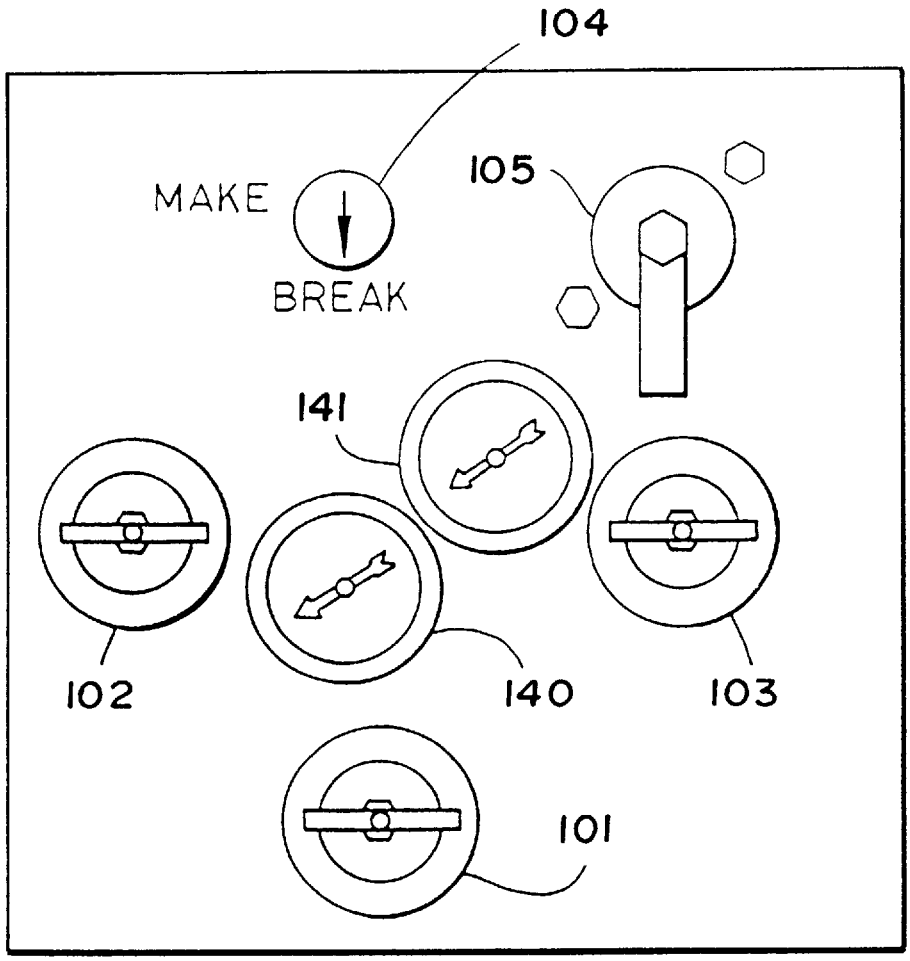
FIG. 3 is a schematic view of a control panel useful with the system of FIG. 1.

FIG. 3 shows one embodiment of a control panel 350 with controls for various valves described above. An operator can use such a control panel, interconnected with the various valves, the piston/cylinder device, the various gauges, and a pressurized air source, on the rig floor, near a tong, or up in a rig derrick. Alternatively such a panel can be wireless, mobile, and/or remote from any location mentioned above. The dotted outline of FIG. 1 encloses items controlled by the control panel of FIG. 3.

FIGS. 4 and 5 present charts useful with methods according to the present invention to determine air pressure ratings corresponding to a joint of a particular weight and for determining "makeup" and "breakout" pressure settings for the various valves described above. In both FIGS. 4 and 5, Column A indicates the weight, in pounds per foot of a joint, e.g. a piece of casing. Column B indicates the weight in pounds of 40 feet of a joint as in Column A. Column C indicates the air pressure in p.s.i. necessary to support the joint of column B—for FIG. 4 the joint compensator (piston/cylinder device) like that of FIG. 1 has a cylinder (like the cylinder 112) with an inner diameter of about ten inches and for FIG. 5 of about three inches. Column D indicates a suggested air pressure setting in p.s.i. for the make-up regulator valve for make-up operations. Column E indicates a suggested air pressure setting in p.s.i. for the breakout regulator valve for breakout operations.

FIGS. 6–11 illustrate a system 500 according to the present invention which is like the system of FIG. 1 in many respects (and the same numerals indicate the same items); but the system 500 provides for continuous compensation and for automatic re-setting of a joint compensator upon breakout of one joint for the next joint to be broken out—in addition to such automatic re-setting for make-up of joints. Whereas in the system of FIG. 1 a manual valve is operated to release a spring cushion (spring and/or gas) from beneath the piston 112, in the system of FIG. 6 a joint compensator has a piston that automatically moves downwardly due to the action of a variety of limit switches and a yoke acted on by the piston. During a breakout operation joints subsequent to a first joint are broken out without the need for operator actuation of a vent valve (e.g. valve 105, FIG. 3).

Figure 6:
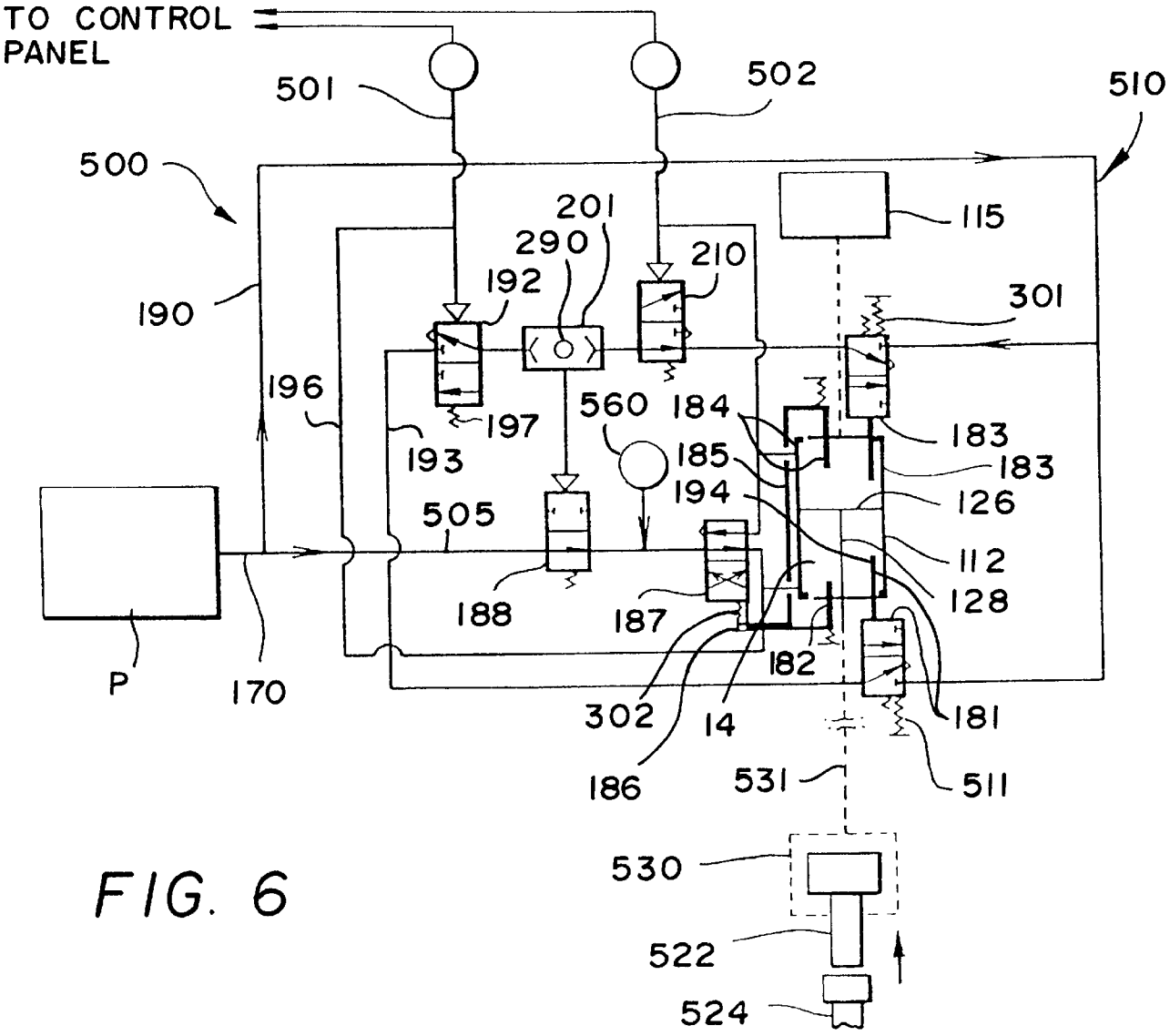
FIGS. 6–11 illustrate schematically operation of a system according to the present invention.

FIG. 6 illustrates use of the system 500 after a joint 522 has been broken out from a joint 524 (joint 524 fixed in a rig). The joint 522 is being lifted by a joint compensator 510 according to the present invention. Air pressure for lifting the joint, from a pressurized air source P, is controlled by valves, flow lines, etc. as in the system and control panel of FIG. 1. In the system 500 a break limit pilot line 501, a make limit pilot line 502, and a pilot line 190 are interconnected with the control panel and system. Air under pressure is supplied at about 110% of "neutral" (estimated joint weight and corresponding air pressure to support same) to the space below the piston 126. Air initially enters a cylinder 112 via an interruption control valve 188 and a directional valve 187 which receive air from the flow line 170 via a flow line 505. An elevator (not shown) connected between the piston rod 128 and. the joint 522 is not moving (as in FIG. 6), but the joint 522 is moving up due to air pressure below the piston 126. Stop valves 181 and 183 positioned adjacent the cylinder 112 are closed due to the pressure of their respective springs 511 and 301.

Figure 7:
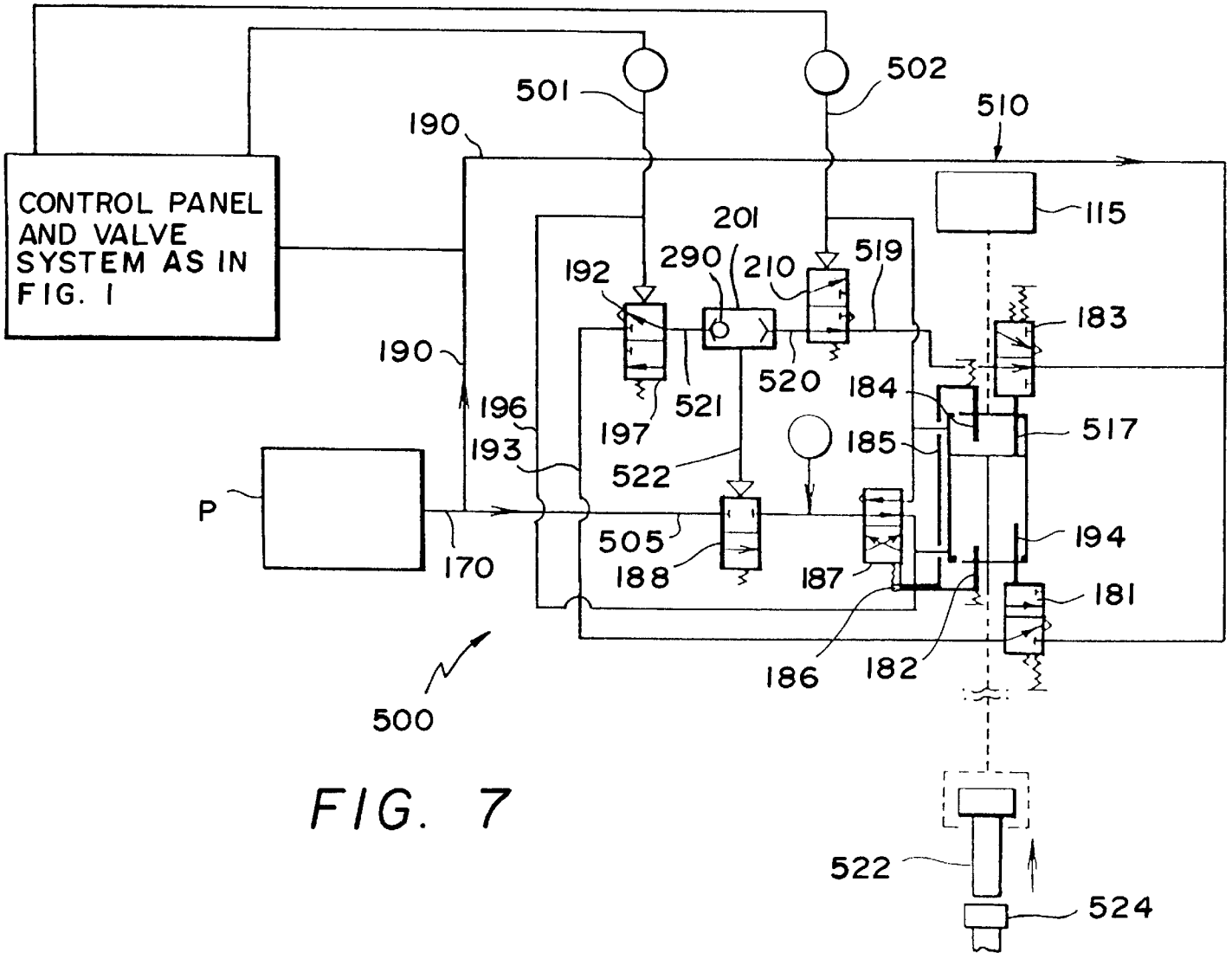

FIG. 7 illustrates the system 500 supporting the joint 522, compensating for its weight, and prepared to release it. The piston 126 has moved up to encounter a movable rod 517 of the stop valve 183, depressing the rod (moving it up in FIG. 7, thereby opening a fluid flow path of signal air to flow to a pilot valve 210 through line 519. This air crosses the pilot valve 210 and enters a shuttle valve 201 which has a movable ball 290 through a line 520. The shuttle valve 201 is open to vent in its opposite side to line 521, the ball 290 closes off the vented side and the signal air pressure is applied through a line 522 to operate the interruption control valve 188. The valve 188 is shifted and blocks further air flow from the source P that is entering the directional valve 187 and the cylinder 112. This blockage arrests the upward motion of the piston 126 and joint 522.

Figure 8:
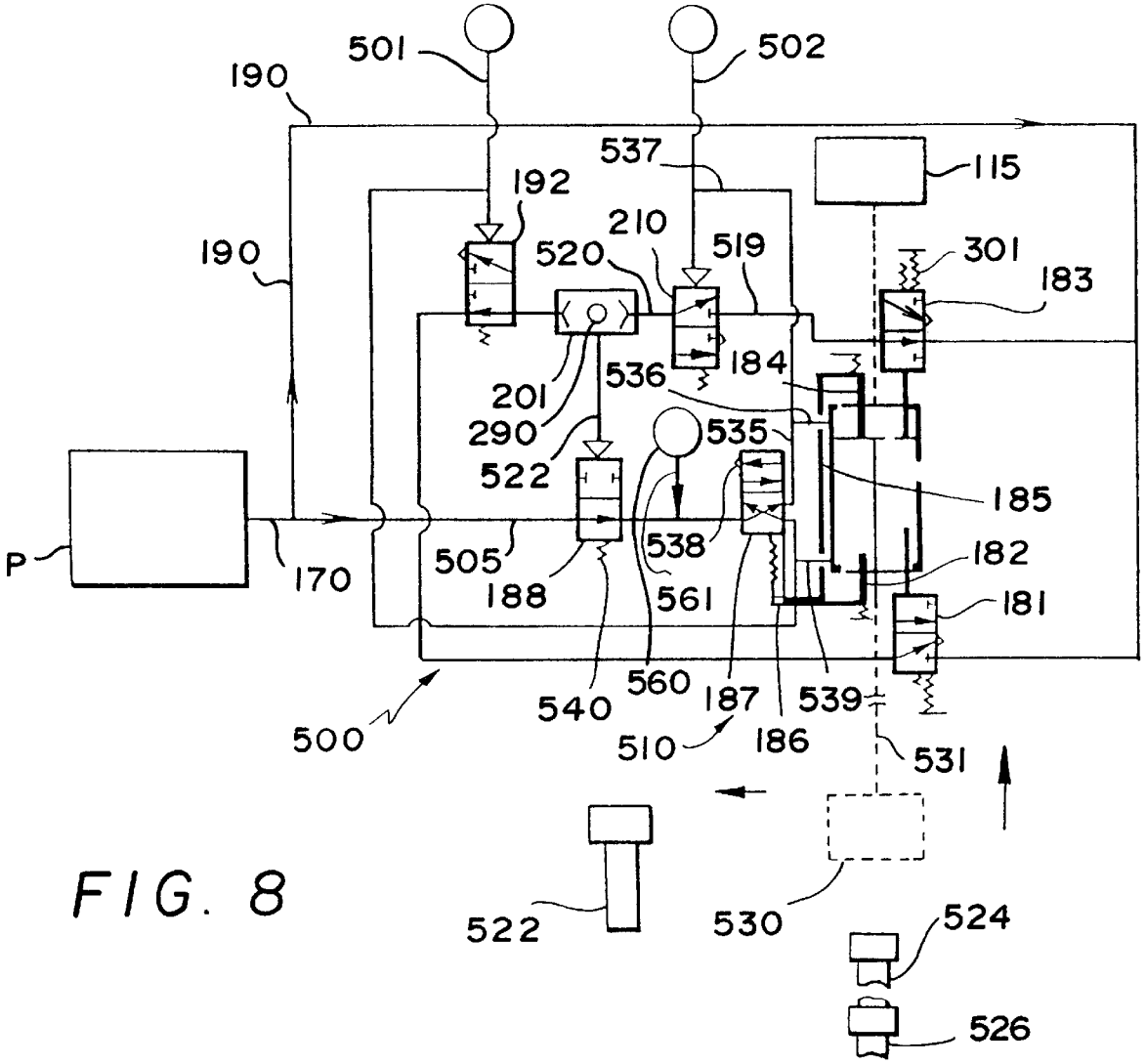

FIG. 8 illustrates the system 500 with the joint 522 released and the system ready to return to break out another subsequent fixed joint, now the joint 524, from a joint 526 to which the joint 524 is fixed. With the joint 522 moved out of the way with typical known joint moving apparatus, the joint 522 is unhooked from the elevator (shown schematically in dotted line as 530 in FIG. 8). The removal of the joint's weight from the joint compensator reduces the load on the piston 126 and on a line 531 creating an increase in the net upward force on the piston 126 which overcomes a supporting spring 301 positioned between the cylinder 112 and the stop valve 183, causing the valve 183 to travel upward with the piston 126. The piston 126 continues upward until it reaches an upper end 184 of a yoke 185 that is movably attached to the directional valve 187. The piston 126 pushes on the yoke 185 causing it to actuate the valve 187 via contact with the finger or pin 186. The yoke 185 and the directional valve 187 may be supported by the cylinder 112 or by a frame work attached thereto. When the valve 187 is actuated by motion of the yoke 185, the directional valve 187 shifts and directs air via lines 535 and 536 to the top of the cylinder 112, and via a line 537 to the top of the pilot valve 210, allowing air from below the piston to vent freely through the valve 187 and vent 538 via a line 539. An operator of the pilot valve 210 actuates the valve 210 to open the branch connected to the shuttle valve 201, permitting the branch and shuttle valve 201 to vent to atmosphere, thus relieving an operator of the control valve 188 whose spring 540 shifts the valve allowing source air to travel to the directional valve 187 and to the top of the piston 126.

Figure 9:
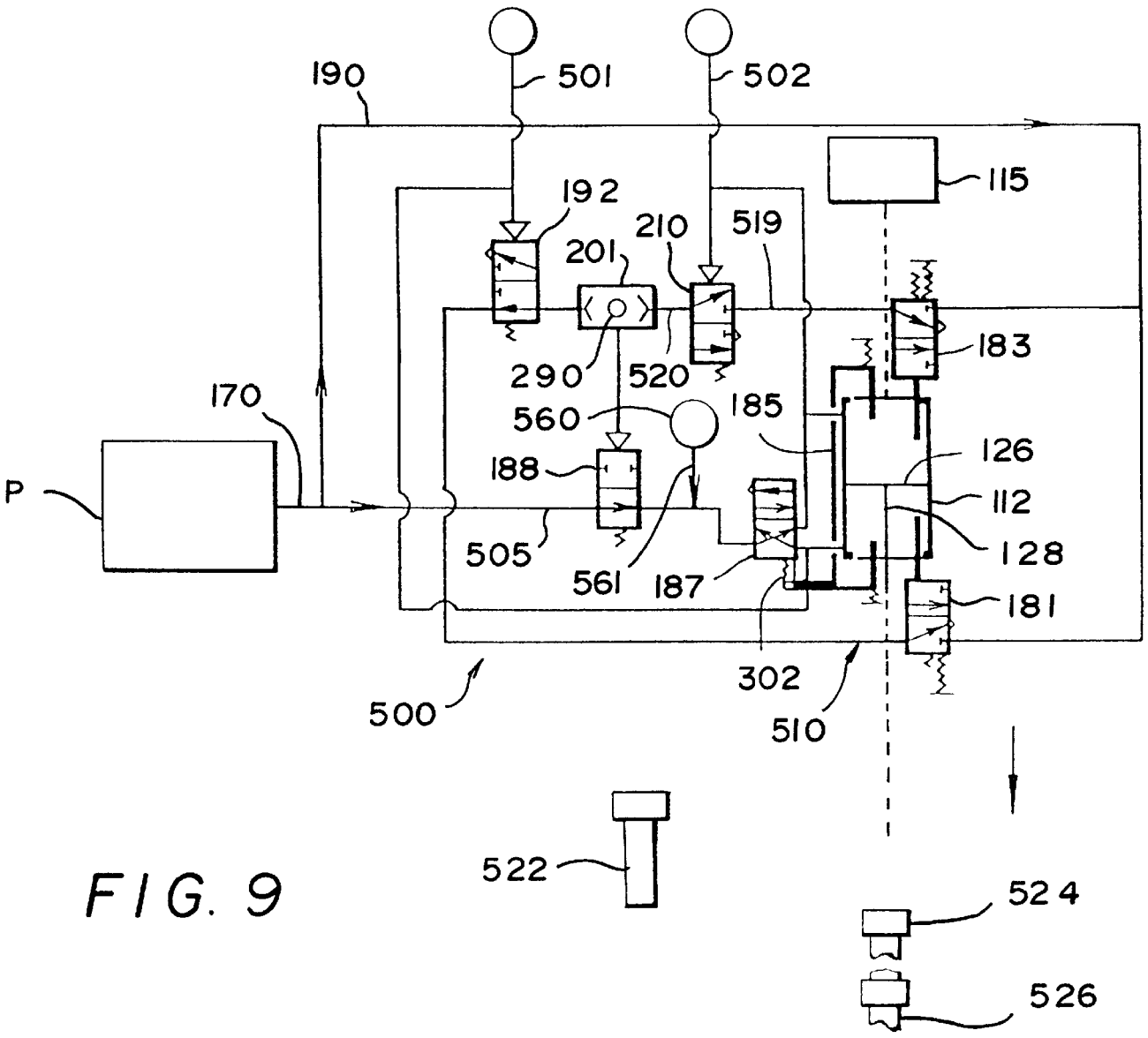

FIG. 9 illustrates the system 500 ready to return to support and compensate another joint for breakout. With air applied to the top of the piston 126, the piston 126 begins to move down to a "start" position for breakout. The yoke 185 which is actuating the directional valve 187 has a locking detent 302 and remains in a shifted position until the opposite end of the yoke 185 is moved and thus air flow to the top of the piston 126 is sustained when the piston 126 breaks contact with the yoke 185 and with the stop valve 183. When the piston moves away from the stop valve 183 on its downward stroke, the valve's spring actuator returns it to normal position, venting air in the line 519.

Figure 10:
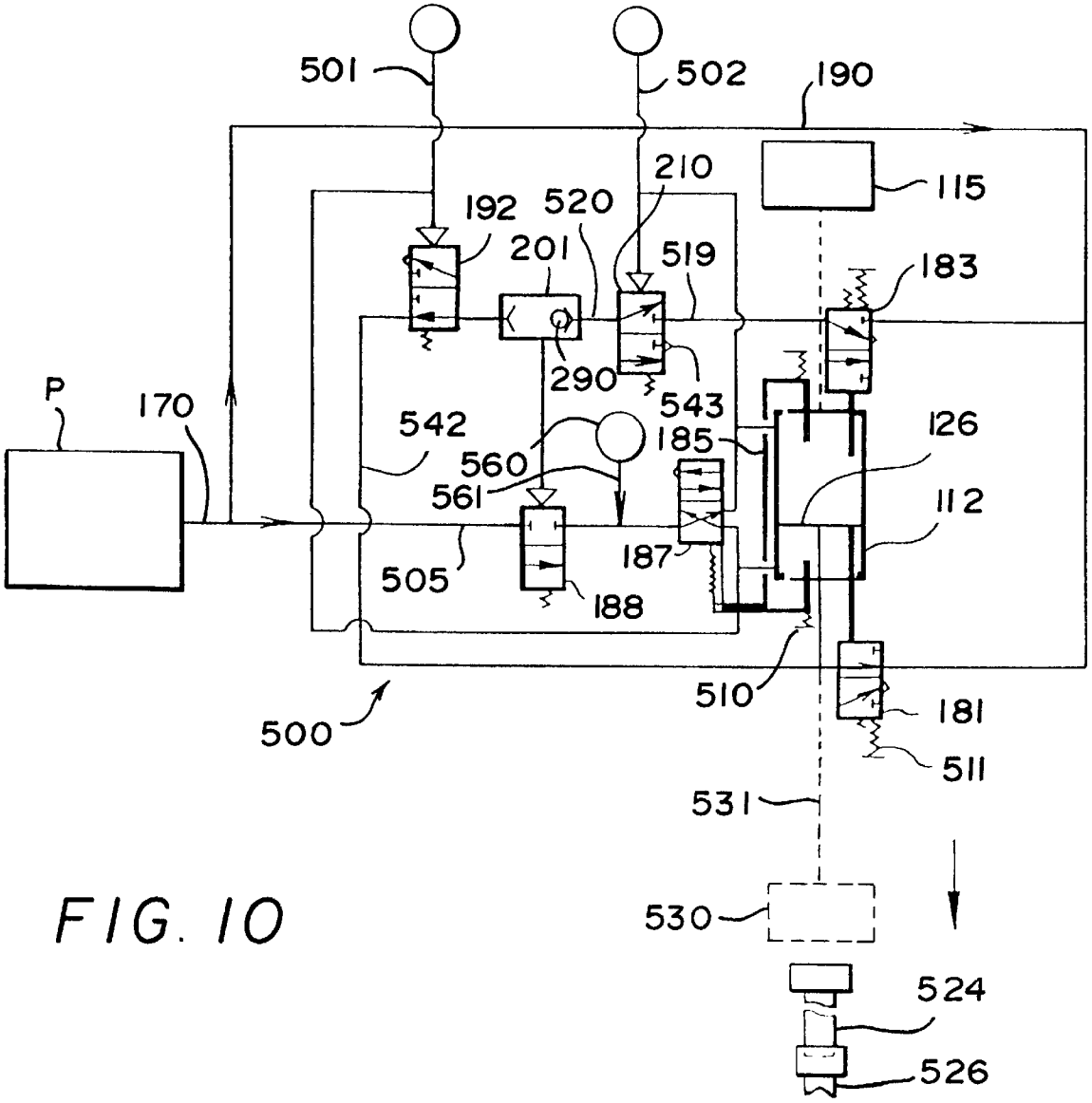

FIG. 10 shows the system 500 ready to latch onto another fixed joint for breakout. The piston 126 continues its downward stroke until it encounters a lower stop valve 181. When the piston 126 moves down sufficiently to actuate the lower stop valve 181 (against its spring 511 positioned between the valve and cylinder or a frame of the cylinder), air is admitted through the valve 181 to a pilot valve 192 via a line 542 and thus to the shuttle valve 201. Since the opposite branch of the shuttle valve 201 is vented to atmosphere via vent 543, the ball 290 closes the vent path and air is admitted to the interrupter control valve 188 which shifts the valve "down," interrupting air flow to the directional valve 187 and to the top of the piston 112. Downward motion of the piston ceases and the joint compensator 510 is ready for attachment to the next fixed joint 524.

Figure 11:
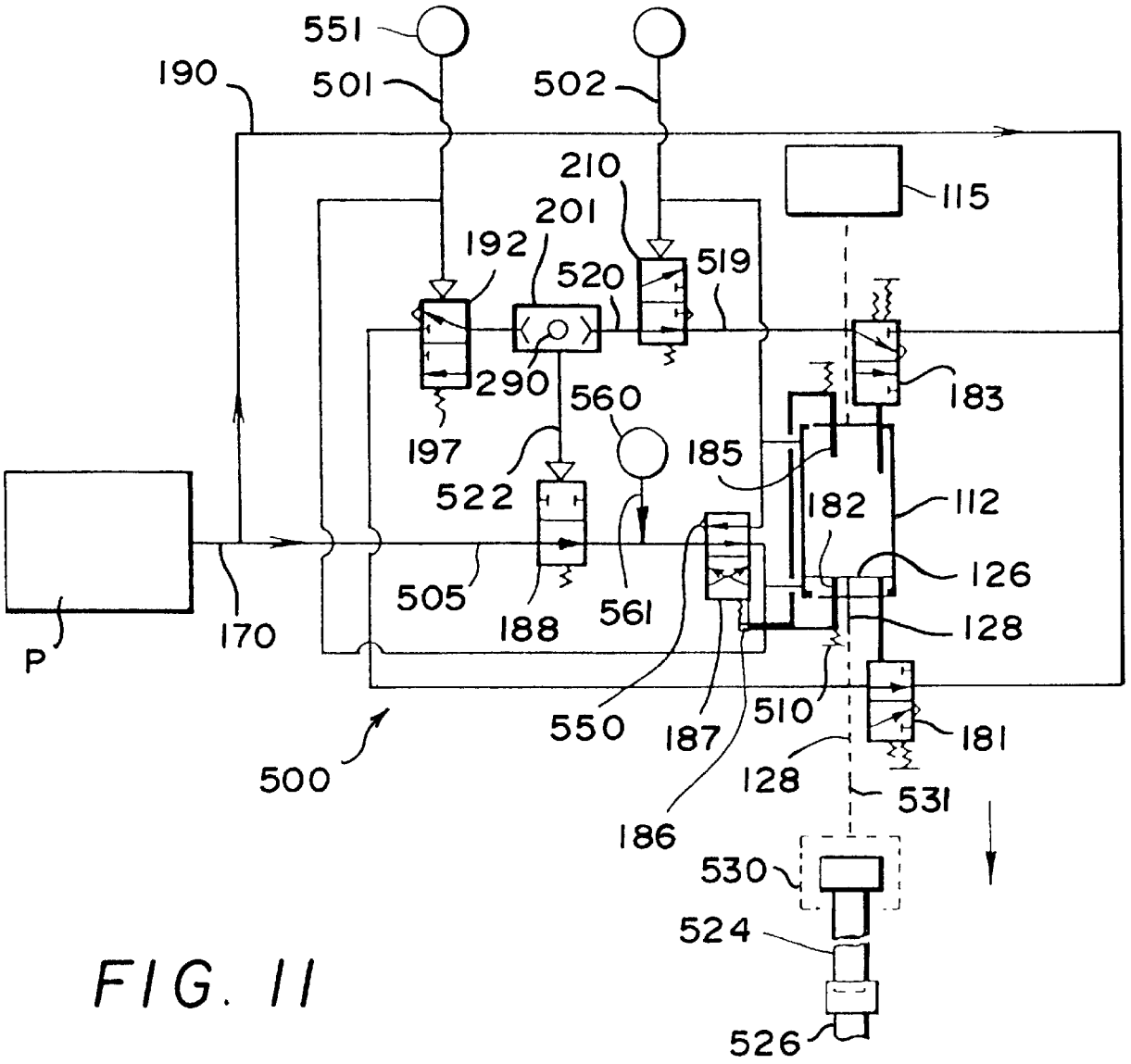

FIG. 11 shows the joint compensator via the elevator 510 latched to the joint 524 and slack taken out of the line 531 (attached to the piston rod 128) by hoising the various items with the travelling block 115 and related apparatus. Upward motion of the cylinder 112 brings a pin 186 of the yoke 185 into contact with the piston 126. This force moves the actuator pin 186 down, shifting the directional valve 187 to a new position. With the directional valve 187 reversed now, air is routed from it to the bottom of the piston 126. The top of the piston 126 is vented through the valve 187 and its vent 550. Air is also applied to the operator of the pilot valve 192 and to a break limit indicator 551. The pilot valve operator moves the pilot valve 192 against its spring 197, allowing venting of air pressure between the pilot valve 192 and the operator of the interrupter control valve 188, which unlatches permitting air flow into the directional valve 187 and the cylinder 112. An accumulator 560 provides additional air volume via a line 561 to operate the pilot valve 192. At this point the joint compensator is ready to apply compensating force upward for the joint 524 and the breakout of the joint proceeds.

As described above various amounts of air (or any other suitable gas) provide a spring cushion above and below a piston in a cylinder. Either amount of air may be replaced by a spring or springs (in one aspect constant force springs). In one aspect a spring is connected to the piston and to the cylinder's interior and another spring, on the same side of the piston, is connected either only to the piston or only to the cylinder. A similar arrangement may be made on the other side of the piston. As shown, e.g. in FIG. 6, various rods and actuators extend into the cylinder 112. With appropriate connections and securements, upper and lower rods connected to the piston and movable therewith, with a portion projecting beyond the cylinder may be used to actuate appropriate valves. The various valves and flow lines of the system 500 (other than the source P and control panel) may be adjacent the joint compensator 510.

For make-up operations, the system 500 is used as is the system of FIG. 1.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A joint compensator for compensating for the weight of a first joint and at least one subsequent joint, the first joint to be supported above the at least one subsequent joint, the joint compensator comprising a body interconnectible between the first joint and a moving apparatus for moving the first joint, the body including supporting apparatus for supporting the first joint above the at least one subsequent joints and for providing support of the first joint as it moves with respect to the at least one subsequent joint, the supporting apparatus compensating for weight of the first joint as it moves, the supporting apparatus comprising a movable piston movably mounted in a hollow cylinder with an amount of gas above the piston and an amount of gas below the piston, the piston connected to a piston rod, part of which projects from the cylinder for interconnection to a joint to be supported by the joint compensator, the support apparatus for alternately supporting the first joint and then the at least one subsequent joint, the support apparatus initially adjustable to compensate for the weight of the first joint so that the support apparatus is also thereby adjusted to compensate for weight of the at least one subsequent joint.

2. The joint compensator of claim 1 wherein the first joint is a fixed joint connected to the at least one subsequent joint, the first joint moved to disengage from the at least one subsequent joint after which the at least one subsequent joint is moved to disengage from a third fixed joint to which the at least one subsequent joint is connected.

3. The joint compensator of claim 1 wherein the joint compensator continuously compensates for weight of a joint connected thereto.

4. A joint compensator for compensating for the weight of a first joint and at least one subsequent joint, the first joint to be supported above the at least one subsequent joint, the joint compensator comprising a body interconnectible between the first joint and a moving apparatus for moving the first joint, the body including supporting apparatus for supporting the first joint above the at least one subsequent joint and for providing support of the first joint as it moves with respect to the at least one subsequent joint, the supporting apparatus compensating for weight of the first joint as it moves, the support apparatus comprising a movable piston movably mounted in a hollow cylinder with a first spring cushion means for cushioning the piston on a first side of the piston and a second spring cushioning means for cushioning the piston on a second side of the piston, and the support apparatus for alternately supporting the first joint and then the at least one subsequent joint, the support apparatus initially adjustable to compensate for the weight of the first joint so that the support apparatus is also thereby adjusted to compensate for weight of the at least one subsequent joint.

5. The joint compensator of claim 4 wherein the first spring cushion means is at least one constant force spring.

6. The joint compensator of claim 4 wherein the second spring cushion means is at least one constant force spring.

7. The joint compensator of claim 4 wherein the first spring cushion means is an amount of air.

8. The joint compensator of claim 4 wherein the second cushion means is an amount of air.

9. The joint compensator of claim 4 further comprising control apparatus for selectively controlling the first spring cushion means and the second spring cushion means.

10. The joint compensator of claim 9 wherein the first spring cushion means is an amount of gas, the second spring cushion means is an amount of gas, and the control apparatus further comprises a valving system and a fluid flow line system interconnecting the first spring cushion means, the second spring cushion means and a source of gas under pressure from which flows gas for the first spring cushion means and the second spring cushion means.

11. The joint compensator of claim 4 wherein the first joint is a fixed joint connected to the at least one subsequent joint, the first joint moved to disengage from the at least one subsequent joint after which the at least one subsequent joint is moved to disengage from a third fixed joint to which the at least one subsequent joint is connected.

12. The joint compensator of claim 4 wherein the joint compensator continuously compensates for weight of a joint connected thereto.

13. The joint compensator of claim 4 wherein the support apparatus comprises a movable piston movably mounted in a hollow cylinder with an amount of gas above the piston and an amount of gas below the piston, the piston connected to a piston rod part of which projects from the cylinder for interconnection to a joint to be supported by the joint compensator.

14. A joint compensator for compensating for the weight of a first joint and at least one subsequent joint, the first joint to be supported above the at least one subsequent joint, the joint compensator comprising a body interconnectible between the first joint and a moving apparatus, the body including supporting apparatus for supporting the first joint above the at least one subsequent joint and for providing support of the first joint as it moves with respect to the at least one subsequent joint, the supporting apparatus compensating for weight of the first joint as it moves, the support apparatus for alternately supporting the first joint and then the at least one subsequent joint, the support apparatus initially adjustable to compensate for the weight of the first joint so that the support apparatus is also thereby adjusted to compensate for weight of the at least one subsequent joint, the support apparatus comprising a movable piston movably mounted in a hollow cylinder with a first spring cushion means for cushioning the piston on a first side of the piston and a second spring cushioning means for cushioning the piston on a second side of the piston, the piston connected to a piston rod part of which projects from the cylinder for interconnection to a joint to be supported by the joint compensator, control apparatus for selectively controlling the first spring cushion means and the second spring cushion means, the first spring cushion means comprising an amount of gas, the second spring cushion means comprising an amount of gas, and the control apparatus further comprising a valving system and a fluid flow line system interconnecting the first spring cushion means, the second spring cushion means and a source of gas under pressure from which flows gas for the first spring cushion means and the second spring cushion means so that the joint compensator continuously compensates for weight of a joint connected thereto.

15. A joint compensator for compensating for the weight of a first joint and at least one subsequent joint, the first joint to be supported above the at least one subsequent joint, the first joint to be supported above the at least one subsequent joint, the joint compensator comprising a body interconnectible between the first joint and a moving apparatus, the body including supporting apparatus for supporting the first joint above the at least one subsequent joint and for providing support of the first joint as it moves with respect to the at least one subsequent joint, the supporting apparatus compensating for weight of the first joint as it moves, the support apparatus for alternately supporting the first joint and then the at least one subsequent joint, the support apparatus initially adjustable to compensate for the weight of the first joint so that the support apparatus is also thereby adjusted to compensate for weight of the at least one subsequent joint, the support apparatus comprising a movable piston movably mounted in a hollow cylinder with a first spring cushion means for cushioning the piston on a first side of the piston and a second spring cushioning means for cushioning the piston on a second side of the piston, wherein the first spring cushion means is at least one constant force spring, and wherein the second spring cushion means is at least one constant force spring, and control apparatus for selectively controlling the first spring cushion means and the second spring cushion means so that the joint compensator continuously compensates for weight of a joint connected thereto.

* * * * *